US006132288A

United States Patent [19]

Aerts

[11] Patent Number: 6,132,288

[45] Date of Patent: Oct. 17, 2000

[54] LIQUID-FILLED NON-FLAMMABLE BRASSIERE PAD

[75] Inventor: Eric T. Aerts, Maplewood, N.J.

[73] Assignee: G22-Altesse Co., Ltd, New York, N.Y.

[21] Appl. No.: 09/309,441

[22] Filed: May 11, 1999

[51] Int. Cl.[7] ..... A41C 3/10

[52] U.S. Cl. ..... 450/38; 450/54; 450/57; 623/7; 623/8

[58] Field of Search ..... 450/38, 54–58; 623/7, 8; 2/267

[56] References Cited

U.S. PATENT DOCUMENTS

| | | | |
|---|---|---|---|
| 2,698,436 | 1/1955 | Bernhardt | 450/37 |
| 3,934,274 | 1/1976 | Hatley, Jr. | 623/7 |
| 4,024,876 | 5/1977 | Penrock . | |
| 4,125,117 | 11/1978 | Lee . | |
| 4,195,639 | 4/1980 | Lee . | |
| 4,298,998 | 11/1981 | Naficy | 623/7 |
| 4,731,081 | 3/1988 | Tiffany et al. . | |
| 4,734,078 | 3/1988 | Moreau . | |
| 4,820,303 | 4/1989 | Brauman . | |
| 4,964,402 | 10/1990 | Grim et al. . | |
| 5,005,232 | 4/1991 | Wright et al. . | |
| 5,098,330 | 3/1992 | Greenberg . | |
| 5,334,082 | 8/1994 | Barker | 450/54 |
| 5,411,554 | 5/1995 | Scopelianos et al. . | |
| 5,458,635 | 10/1995 | Berman . | |
| 5,676,698 | 10/1997 | Janzen et al. . | |
| 5,679,052 | 10/1997 | Rucki | 450/57 |
| 5,693,164 | 12/1997 | Chang . | |
| 5,733,335 | 3/1998 | Ishikawa et al. . | |
| 5,782,671 | 7/1998 | Suen et al. | 450/38 |
| 5,798,062 | 8/1998 | Thielbar . | |
| 5,823,852 | 10/1998 | Chu | 450/38 |
| 5,824,075 | 10/1998 | Thielbar . | |
| 5,944,578 | 8/1999 | Lin et al. | 450/57 |
| 5,989,101 | 11/1999 | Jenn-Shyang et al. . | |
| 5,997,380 | 12/1999 | Yang | 450/57 |
| 6,015,332 | 1/2000 | Lee et al. . | |
| 6,020,055 | 2/2000 | Pearce . | |

FOREIGN PATENT DOCUMENTS

| | | |
|---|---|---|
| WO 00/08960 | 2/2000 | WIPO . |

*Primary Examiner*—Gloria M. Hale
*Attorney, Agent, or Firm*—Brown, Raysman, Millstein, Felder & Steiner LLP

[57] ABSTRACT

A brassiere pad is used in a cup of a brassiere, with the brassiere pad retaining a non-flammable liquid and positioned within the cup for enhancing the appearance of the breast. The non-flammable liquid includes a humectant and a glycerine-based fluid, and the brassiere pad may include a main chamber for retaining the non-flammable liquid, and a tapered chamber connected to the main chamber by a canal to allow the liquid to pass between the tapered chamber and the main chamber. The brassiere pad may be composed of polyurethane.

11 Claims, 2 Drawing Sheets

LIQUID-FILLED NON-FLAMMABLE BRASSIERE PAD

COPYRIGHT NOTICE

A portion of the disclosure of this patent document contains material which is subject to copyright protection. The copyright owner has no objection to the facsimile reproduction by anyone of the patent document or the patent disclosure, as it appears in the U.S. Patent and Trademark Office patent files or records, but otherwise reserves all copyright rights whatsoever.

BACKGROUND OF THE INVENTION

The present invention relates to accessories for brassieres, and, more particularly, to a brassiere pad fillable with non-flammable liquid.

Brassiere pads are known in the art which, when inserted into or otherwise incorporated as part of a brassiere, enhance the appearance of a breast. For example, the breasts may appear enlarged, rounder, and/or relatively higher in position on a woman's chest.

To imitate the fluidic aspects of a natural breast, manufacturers of such brassiere pads have used liquids such as water, silicon-gel, and oil to provide similar texture and movement of a natural breast. However, the prior art attempts to attain such enhancements have various disadvantages. For example, water-filled pads may be relatively easy and inexpensive to construct, but such pads may be too liquid in texture and/or appearance. In addition, the fluidic properties of the water cause the pad to produce an embarrassing swishing sound during even normal motion of the woman wearing such a water-filled pad. In addition, for pads fabricated of polyurethane (PU) films and sheets, water can more easily evaporate through the PU film, which may deflate the pad over time and so lose any natural appearance. Accordingly, the effective lifetime of the water-filled pads is limited, and such pads may require refills or replacements.

On the other hand, silicon-gel pads may be too firm and uncomfortable to touch and to wear. The silicon-gel acts more like a solid than a liquid in resisting motion and contact. Accordingly, such pads often do not even remotely reproduce the desired texture of a natural breast.

Other brassiere pads use oils, such as known mineral oils, as the filling, and so the oil-filled pads may fairly accurately reproduce the natural feel of a real breast. However, oils are typically highly flammable, and so present an additional danger in both normal and extreme circumstances. In addition, the dangers may be compounded by the proximity of such oil to fabrics. If such an oil-based brassiere pad is punctured and so allowing the oil to mix and be absorbed by the fabric of the bra as well as any outlying clothing, then the combination of fabric and oil may spread and increase the area over which an ignited portion of the oil can cause harm to the wearer of the bra.

A need exists for a brassiere pad which provides a natural texture and appearance to enhance the breasts.

A need also exists for a brassiere pad which moves as does a natural breast during normal motion of the wearer.

A need also exists for a liquid-filled brassiere pad in which such liquid is non-flammable.

SUMMARY OF THE INVENTION

A brassiere pad is disclosed for use in a cup of a brassiere, with the brassiere pad retaining a non-flammable liquid and positioned within the cup for enhancing the appearance of the breast. The non-flammable liquid includes a humectant and a glycerine-based fluid, and the brassiere pad may include a main chamber for retaining the non-flammable liquid, and a tapered chamber connected to the main chamber by a canal to allow the liquid to pass between the tapered chamber and the main chamber. The brassiere pad may be composed of polyurethane.

DETAILED DESCRIPTION OF THE PREFERRED EMBODIMENT

Figure 1:
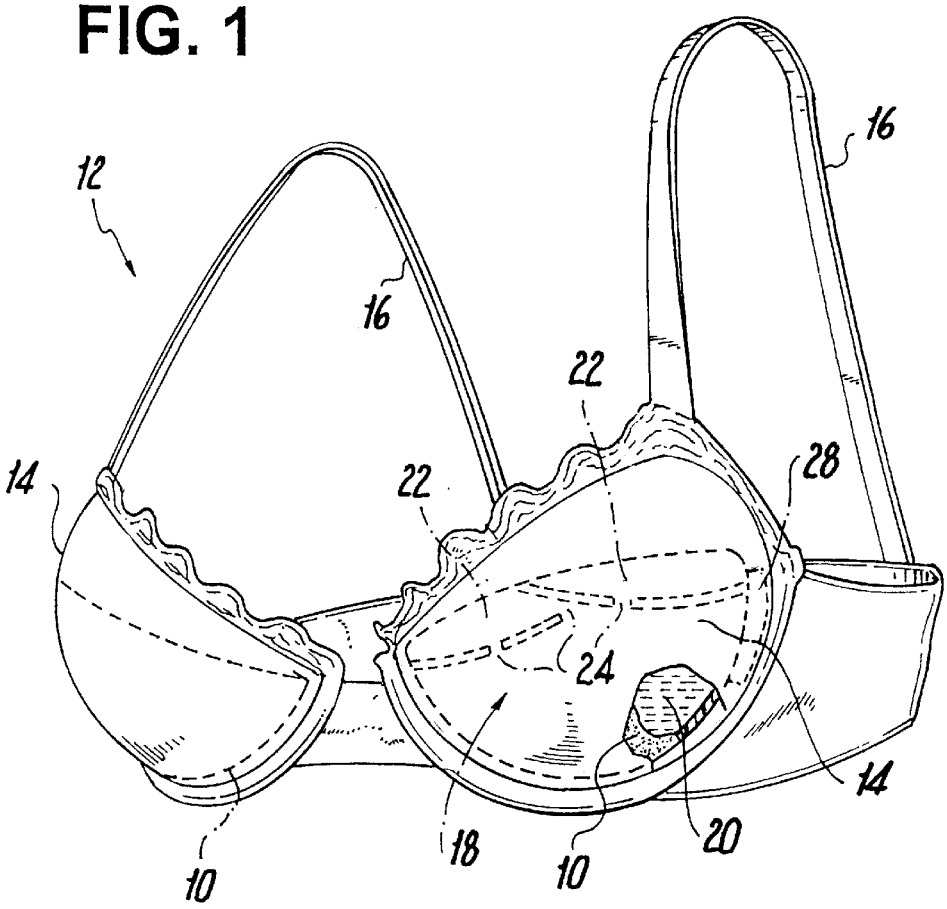
FIG. 1 illustrates a front perspective view of a brassiere incorporating the disclosed brassiere pad.
Figure 3:
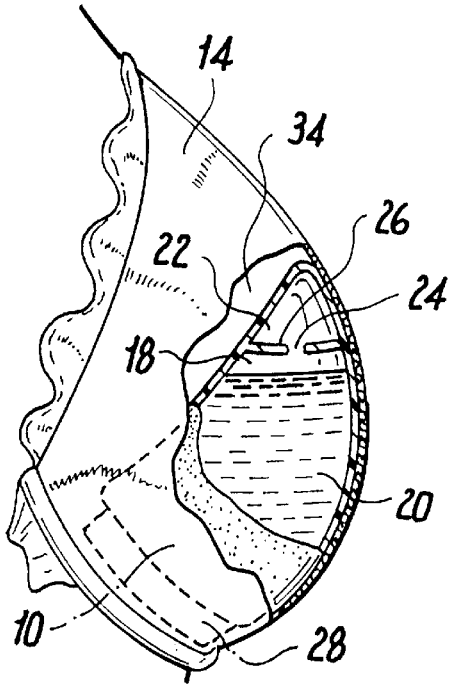
FIG. 3 illustrates an alternative side cross-sectional view of the brassiere pad of FIG. 2.

Referring to FIG. 1, a brassiere pad 10 is shown for use in a brassiere 12 having at least one cup 14 and at least one strap 16 connected to the cup 14 for holding a breast. The brassiere pad 10 retains a liquid and is positioned within the cup 14 for enhancing the appearance of the breast, for example, in one alternative use for uplifting the breast 34, as shown in FIG. 3.

Figure 2:
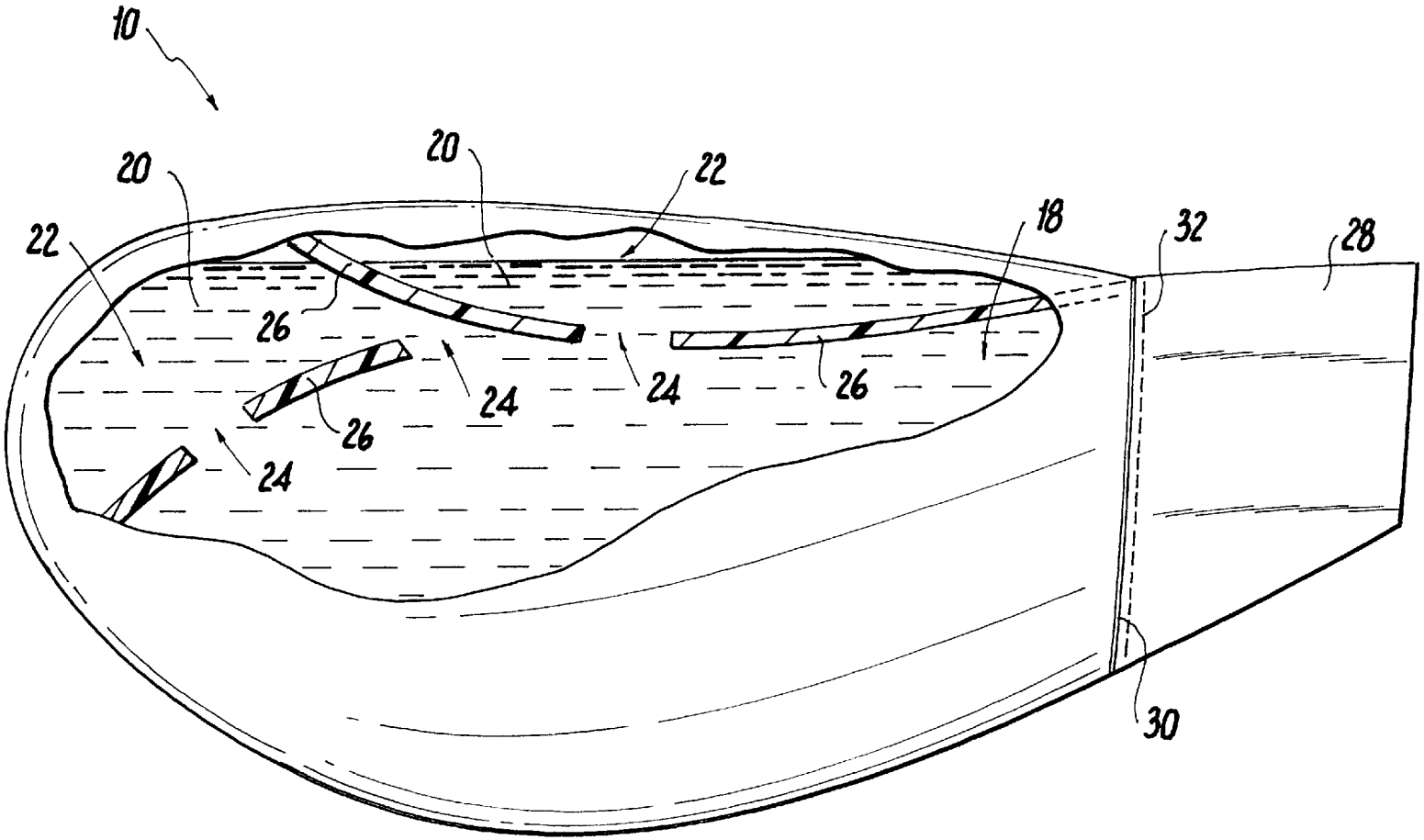
FIG. 2 illustrates a front cross-sectional view of the brassiere pad in greater detail.

Referring to FIG. 2 in conjunction with FIG. 1, the brassiere pad 10 is composed of films or sheets of material, such as polyurethane (PU), to form a generally oblong bladder-like container having a main chamber 18 for retaining the non-flammable liquid 20, as well as at least one secondary chamber or tapered chamber 22 connected to the main chamber 18 by at least one canal 24 to allow the liquid 20 to pass between the tapered chamber 22 and the main chamber 18. The pad 10 may be retained and/or sewn into a pocket of the cup 14, and so may be removable. The walls 26 forming the chambers 18, 22 may be similarly formed of polyurethane, and so are flexible to retain varying amounts of the liquid 20. The polyurethane may be of a predetermined and/or minimum thickness, such as 0.006 inches (0.01524 cm.), and the walls 26 and chambers 18, 22 may be formed by heat-sealed seams. By using polyurethane and heat-sealed seams, the pad 10 is substantially puncture-resistant, and is also environmentally safer than other known polymer-based film materials such as "VINYL" film materials, yet the polyurethane pad 10 is softer while being typically less expensive than known "VINYL" film materials.

The multi-chambered configuration of the pad 10 with the canals 24 allows the liquid 20 to flow into and out of the chambers 18, 22 as the cup 14 and/or pad 10 are contacted. Accordingly, when contact pressure is applied, the liquid 20 in the chambers 18, 22 flows to simulate the corresponding motion of a natural breast to such contact pressure. When contact pressure is removed, the shapes of the chambers 18, 22 cause the liquid 20 to flow out of the chambers 18, 22 in an appropriate direction, for example, in response to gravity. For a woman wearing the pad 10 while the woman oriented in an upright position, and with the pad 10 fabricated and positioned in an alternative configuration to uplift the breast 34 such as shown in FIG. 3, the shape of the tapered chamber 22 causes a portion of the liquid 20 to flow out through the canals 24 to the main chamber 18, and so creates a more natural appearance of a real breast shape in response to gravity. For example, with the pad 10 configured to uplift the breast 34 as in FIG. 3, the pad 10 and breast 34 maintain a general natural shape, and also have a more natural texture.

In an alternative embodiment, the pad 10 may include a flap or tab portion 28 attached to the remainder of the pad 10, for example, attached to the main chamber 18, by a seam 30. The tab portion 28 allows the pad 10 to be attached to the brassiere 12 through a sew line 32. Other mechanisms for attaching the pad 10 to the brassiere 12, for example, at the cup 14 may include buttons, laces, hook-and-loop fasteners such as "VELCRO", and/or any other attaching devices to allow the pad 10 to be either permanently or removably attached to the brassiere 12 to be respectively permanently or removably positioned in the cup 14.

The liquid 20 is a non-flammable liquid, except for water and silicon-gel which do not provide a sufficiently natural texture while having the various disadvantages described herein. In a preferred embodiment, the liquid 20 is a non-flammable combination of a humectant and a glycerine-based fluid. A humectant is a non-toxic, non-hazardous chemical which is added to retard drying, typically used in liquid colorant and water base screen inks as well as reactive printing. One example humectant is polyethylene glycol (PEG), which is used for such liquid colorant and water base screen inks, while urea is another example humectant used extensively in reactive printing.

In a preferred embodiment, the humectant has Chemical Abstracts Registry Service (CAS) Number 50-70-4, and the glycerine-based fluid has CAS Number 56-81-5, and so provides a non-toxic and non-flammable combination. By using the humectant in combination with the polyurethane, the disadvantage of evaporation of prior art liquid-filled brassiere pads is overcome. In addition, the combination of the liquid 20 and the polyurethane material for the chambers 18, 22 proves a far more supple and natural feeling material for use in the brassiere pad 10 than prior art liquids and compositions for the walls of prior art brassier pads.

By the foregoing a novel and unobvious brassiere pad 10 has been disclosed by way of the preferred embodiment. However, numerous modifications and substitutions may be had without departing from the spirit of the invention. For example, while the preferred embodiment discusses using glycerine and a humectant instead of water, it is wholly within the purview of the invention to contemplate water-based non-flammable liquids such as water combined with a thickening agent as well as an evaporation inhibitor such as a humectant in the manner as set forth above, such that the water-based liquid, being thickened, does not present the embarrassing sound qualities of pure-water-based liquid-filled pads in the prior art. Accordingly, the invention has been described by way of illustration rather than limitation.

What is claimed is:

1. A brassiere having a cup and at least one strap connected to the cup for holding a breast, and having a brassiere pad for retaining a liquid and positioned within the cup for enhancing the appearance of the breast, the brassiere comprising:

a non-flammable liquid retained in the liquid-filled brassiere pad;

a main chamber for retaining the non-flammable liquid; and a tapered chamber connected to the main chamber by a canal to allow the liquid to pass between the tapered chamber and the main chamber.

2. The brassiere of claim 1, wherein the non-flammable liquid includes a humectant and a glycerine-based fluid.

3. The brassiere pad of claim 1, wherein the brassiere pad is composed of polyurethane.

4. A brassiere pad comprising:

at least one chamber for retaining a non-flammable liquid, wherein the at least one chamber includes:

a main chamber for retaining the non-flammable liquid; and a tapered chamber connected to the main chamber by a canal to allow the liquid to pass between the tapered chamber and the main chamber.

5. A brassiere pad comprising:

at least one chamber for retaining a non-flammable liquid, wherein the non-flammable liquid includes a water-base combined with a thickening agent and an evaporation inhibitor.

6. A brassiere pad for use in brassieres comprising:

a non-flammable liquid;

a main chamber for retaining the non-flammable liquid; and a tapered chamber connected to the main chamber by a canal to allow the liquid to pass between the tapered chamber and the main chamber.

7. The brassiere pad of claim 6, wherein the at least one chamber is composed of polyurethane to substantially prevent evaporation of the liquid out of the brassiere pad.

8. The brassiere pad of claim 6, wherein the non-flammable liquid includes glycerine.

9. The brassiere pad of claim 6, wherein the non-flammable liquid includes a humectant and a glycerine-based fluid.

10. The brassiere pad of claim 9, wherein the humectant is polyethylene glycol.

11. The brassiere pad of claim 9, wherein the humectant is urea.

* * * * *